US008071266B2

(12) United States Patent
Ogura et al.

(10) Patent No.: US 8,071,266 B2
(45) Date of Patent: Dec. 6, 2011

(54) ELECTROPHOTOGRAPHIC PHOTORECEPTOR, AND PROCESS CARTRIDGE AND IMAGE FORMING APPARATUS EMPLOYING THE SAME

(75) Inventors: Kunihiro Ogura, Tokyo (JP); Hirofumi Hayata, Tokyo (JP); Masahiko Kurachi, Tokyo (JP); Toshiyuki Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 871 days.

(21) Appl. No.: 11/861,395

(22) Filed: Sep. 26, 2007

(65) Prior Publication Data

US 2008/0187848 A1 Aug. 7, 2008

(30) Foreign Application Priority Data

Oct. 5, 2006 (JP) ..... 2006-273760

(51) Int. Cl.
*G03G 5/14* (2006.01)

(52) U.S. Cl. ..... 430/58.05; 430/66

(58) Field of Classification Search ..... 430/58.05, 430/66

See application file for complete search history.

(56) References Cited

U.S. PATENT DOCUMENTS 6,605,400 B2 * 8/2003 Itami et al. ..... 430/66

FOREIGN PATENT DOCUMENTS

| | | |
|---|---|---|
| JP | 06-236063 | 8/1994 |
| JP | 2003-091088 | 3/2003 |
| JP | 2004-219922 | 8/2004 |
| JP | 2005-037562 | 2/2005 |
| JP | 2005-227742 | 8/2005 |
| JP | 2006-010816 | 1/2006 |
| JP | 2006-084941 | 3/2006 |
| JP | 2006-184803 | 7/2006 |

OTHER PUBLICATIONS

Machine English language translation of JP 2006-010816, Jan. 2006.*

Japanese Office Action Mailing No. 300287 (4 pages) with English language translation thereof (6 pages).

* cited by examiner

*Primary Examiner* — Hoa V Le

(74) *Attorney, Agent, or Firm* — Lucas & Mercanti, LLP

(57) ABSTRACT

An objective is to provide a high releasing electrophotographic photoreceptor exhibiting lubricity and mechanical strength. The photoreceptor possessing a photosensitive layer on a conductive support, wherein an outermost layer of the photoreceptor comprises a fluorine resin represented by the following formula.

wherein each of X, Y and Z represents a hydrogen atom, a halogen atom, a halogen-substituted alkyl group or a halogen-substituted alkoxy group; at least one of X, Y and Z represents a fluorine atom; each of $R_4$, $R_5$, $R_6$ and $R_7$ represents a hydrogen atom, a halogen atom or a halogen-substituted alkyl group; each of $R_1$, $R_2$, and $R_3$ represents a hydrogen atom, a halogen atom or a halogen-substituted alkyl group; at least one of $R_1$, $R_2$, and $R_3$ represents a fluorine atom; n1 represents an integer of 1-8000; and n2 represents an integer of 0-4000.

8 Claims, 4 Drawing Sheets

ELECTROPHOTOGRAPHIC PHOTORECEPTOR, AND PROCESS CARTRIDGE AND IMAGE FORMING APPARATUS EMPLOYING THE SAME

This application claims priority from Japanese Patent Application No. 2006-273760 filed on Oct. 5, 2006, which is incorporated hereinto by reference.

TECHNICAL FIELD

The present invention relates to an electrophotographic photoreceptor, and a process cartridge and an image forming apparatus employing the same.

BACKGROUND

In an electrophotographic process used in a laser beam printer, a fax machine and so forth, various durability properties are desired since an electrophotographic photoreceptor undergoes the action of electrification, exposure to light, development, transfer, cleaning, removal of electrification and so forth. Specifically, mechanical strength such as wear resistance and scratch resistance is to be a large factor to determine the durability life.

In the electrophotographic process, cleaning is largely associated with the mechanical strength such as wear resistance of the photoreceptor. In recent years, with small-sizing of developer particles, higher precision cleaning has been demanded. Further, in line with small-footprinting of an apparatus, application of blade cleaning has an advantage in realization of a simpler apparatus structure. The blade cleaning is composed of a simple structure in which an elastic member formed from plate-shaped polyurethane or such is simply thrust in the bus bar direction of the photoreceptor. However, in this case, wear of the photoreceptor is accelerated, whereby a decline of durability is generated. In order to deal with the foregoing subject, it is effective to reduce frictional force with the blade by providing lubricity to the photoreceptor or to provide strength durable against frictional force with the photoreceptor.

First, in order to provide lubricity to the photoreceptor, addition of a material having low surface energy is effective, but addition of a fluorine resin is more effective (refer to Patent Documents 1 and 2, for example). Polytetrafluoroethylene (PTFE) possesses the lowest surface energy and exhibits excellent lubricity and nonadhesiveness among fluorine resins, and also a conventional PTFE containing no fluorine at the terminal exhibits lubricity and nonadhesiveness together with water and oil repellency immediately after coating and film formation, but the water and oil repellency tends to be lowered, resulting in an insufficient practical application in a present situation. Further, in the case of excessive addition of PTFE into a coating solution to maintain high oil repellency, a mechanical strength of a film becomes insufficient since PTFE itself is very flexible, resulting deterioration of filming and scratch resistance.

Next, in order to provide strength durable against frictional force to the photoreceptor, it is effective to produce a high molecular binder resin or to use a curable binder resin. However, in a coating process as a major manufacturing process of an organic photoreceptor, production of high molecular binder resins is to be limited since the high molecular binder resin causes thickening of a coating material. In the case of conventional curable binder resins, an insufficient photoconductive property tends to be obtained since reaction of an organic photoconductive material is deteriorated during curing, and an impurity level is formed by an unreacted functional group, a polymerization initiator by-product.

For example, a surface layer exhibiting mechanical strength is possible to be obtained via radical polymerization of monomers or oligomers having an acrylate group or a methacrylate group as a most readily curable material (refer to Patent Document 3, for example). These have a carboxylic acid ester structure having an acrylate group or a methacrylate group, and exhibit high moisture adsorption. Further, there is a drawback such that a curable material exhibits insufficient moisture resistance, since an initiator to start radical polymerization tends to form a moisture adsorption decomposed product via decomposition of the initiator. The decomposed product of the initiator tends also to act as a trap of photocarriers, causing another drawback in which photoreceptor characteristics are deteriorated. Further, there is a problem such that a curing process is not sufficiently accelerated in the case of a film as utilized for a photoreceptor, since radical polymerization is inhibited by oxygen in the air.

On the other hand, typical cationic polymerizing compounds are vinyl ether compounds or epoxy compounds (Patent Documents 4 and 5, for example), but a longer curing time is consumed since polymerization reaction is difficult to be accelerated in comparison to radical polymerization, whereby desired mechanical strength can not be obtained. Further, there is another problem such that in the case of a photoreceptor in which particles are added into a cationic polymerizing compound, particles settle out via aging when a compound to start cationic polymerization used for reaction-curing a cationic polymerizing compound is added into a dispersion, and particles are coagulated during coating a surface layer, whereby smoothness and transparency of a coated layer is to be deteriorated.

When a conventional PTFE containing no fluorine at the terminal is also employed as a compound to start cationic polymerization, image smear is easy to be generated at high humidity. Details have not yet been clear, but a conventional PTFE possesses a high hydrophilic functional group such as a hydroxyl group or a carboxylic acid, reaction gas such as ozone or $NO_X$ generated during electrification at high humidity is easy to be picked up at the terminal of PTFE, and the generated acid is localized at the terminal of PTFE, whereby an ion conducting path is presumably easy to be formed.

(Patent Document 1) Japanese Patent O.P.I. Publication No. 2006-84941

(Patent Document 2) Japanese Patent O.P.I. Publication No. 2005-37562

(Patent Document 3) Japanese Patent O.P.I. Publication No. 2005-227742

(Patent Document 4) Japanese Patent O.P.I. Publication No. 6-236063

(Patent Document 5) Japanese Patent O.P.I. Publication No. 2006-184803

SUMMARY

It is an object of the present invention to provide a high releasing electrophotographic photoreceptor maintaining lubricity for a long duration and exhibiting high mechanical strength. Disclosed is an electrophotographic photoreceptor comprising a conductive support and provided thereon, a photosensitive layer, wherein an outermost layer of the elec trophotographic photoreceptor comprises a fluorine resin represented by Formula (1):

Formula (1)

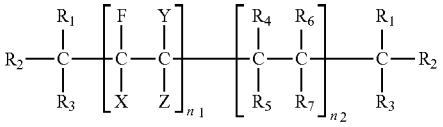

wherein each of X, Y and Z independently represents a hydrogen atom, a halogen atom, a halogen-substituted alkyl group or a halogen-substituted alkoxy group; at least one of X, Y and Z represents a fluorine atom; each of $R_4$, $R_5$, $R_6$ and $R_7$ independently represents a hydrogen atom, a halogen atom or a halogen-substituted alkyl group, provided that the halogen atom is not a fluorine atom, and repeating units represented by "—CF(X)—CY(Z)-" or "—$CR_4(R_5)$—$CR_6(R_7)$" may be identical or different; each of $R_1$, $R_2$, and $R_3$ independently represents a hydrogen atom, a halogen atom or a halogen-substituted alkyl group; at least one of $R_1$, $R_2$, and $R_3$ represents a fluorine atom; n1 represents an integer of 1-8000; and n2 represents an integer of 0-4000.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
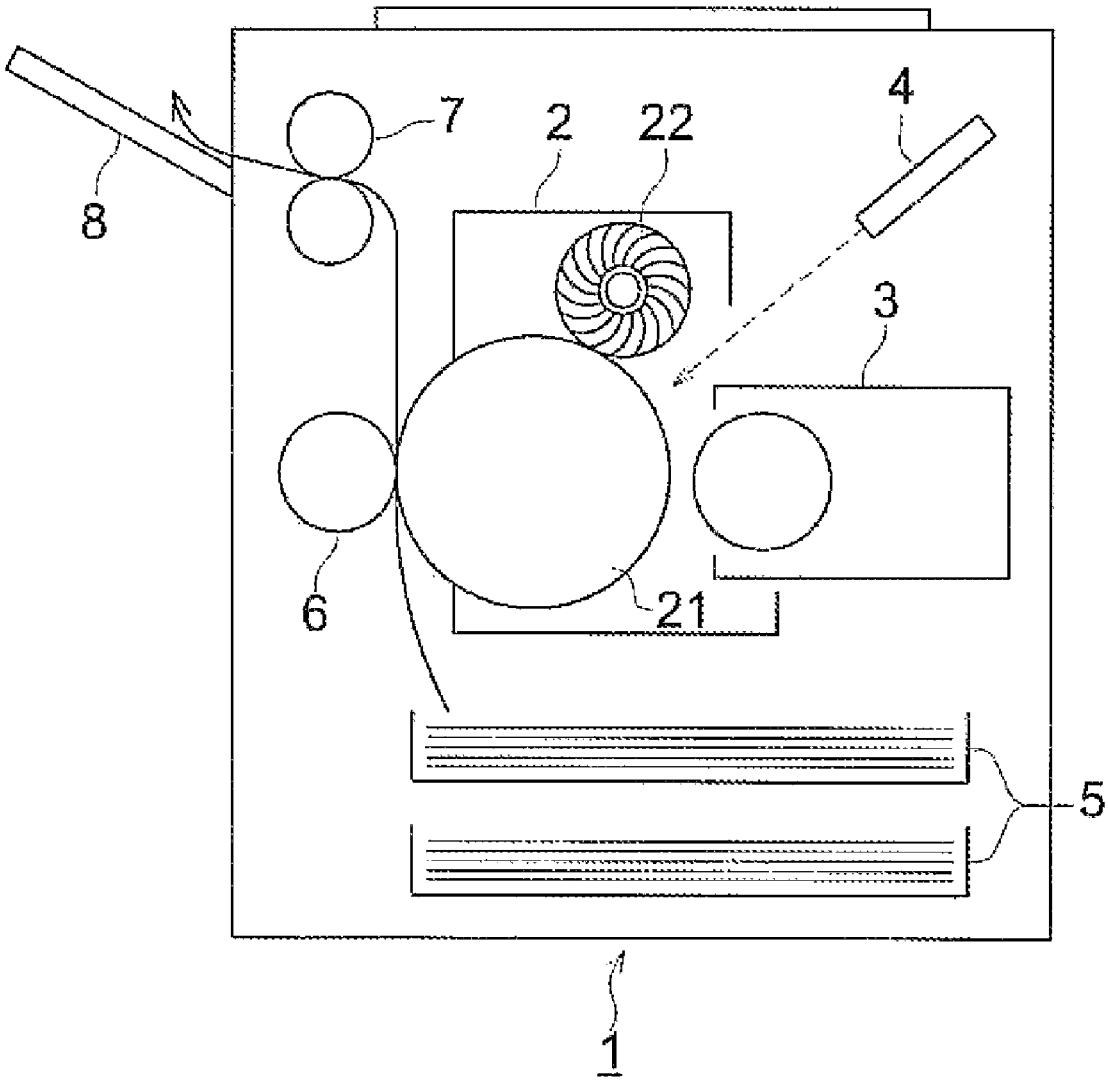
FIG. 1 is a schematic cross-sectional view of image forming apparatus 1 employing a contact electrification system of the present invention.

The above object of the present invention is accomplished by the following structures.

(Structure 1) An electrophotographic photoreceptor comprising a conductive support and provided thereon, a photosensitive layer, wherein an outermost layer of the electrophotographic photoreceptor comprises a fluorine resin represented by Formula (1):

Formula (1)

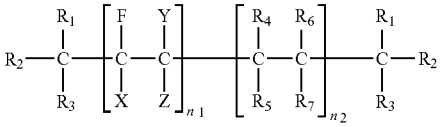

wherein each of X, Y and Z independently represents a hydrogen atom, a halogen atom, a halogen-substituted alkyl group or a halogen-substituted alkoxy group; at least one of X, Y and Z represents a fluorine atom; each of $R_4$, $R_5$, $R_6$ and $R_7$ independently represents a hydrogen atom, a halogen atom or a halogen-substituted alkyl group, provided that the halogen atom is not a fluorine atom, and repeating units represented by "—CF(X)—CY(Z)-" or "—$CR_4(R_5)$—$CR_6(R_7)$" may be identical or different; each of $R_1$, $R_2$, and $R_3$ independently represents a hydrogen atom, a halogen atom or a halogen-substituted alkyl group; at least one of $R_1$, $R_2$, and $R_3$ represents a fluorine atom; n1 represents an integer of 1-8000; and n2 represents an integer of 0-4000.

(Structure 2) The electrophotographic photoreceptor of claim 1, wherein the fluorine resin is polytetrafluoroethylene represented by Formula (2):

Formula (2) $CF_3$—$(CF_2$—$CF_2)_m$—$CF_3$, provided that m represents an integer of 1-8000.

(Structure 3) The electrophotographic photoreceptor of Structure 1, wherein the photosensitive layer comprises a charge generating layer, a first charge transporting layer containing a charge transporting material and a second charge transporting layer containing a charge transporting material that are laminated in this order, and the second charge transporting layer is the outermost layer.

(Structure 4) The electrophotographic photoreceptor of any one of structures 1-3, wherein the outermost layer is an activation energy radiation cationic reaction curing film acquired by exposing to activation energy radiation a composition comprising a compound having a cationic polymerization functional group and a compound to start cationic polymerization via exposure to activation energy radiation, and the compound to start cationic polymerization is a nonionic compound.

(Structure 5) The electrophotographic photoreceptor of Structure 4, wherein the compound having a cationic polymerization functional group comprises an oxetane compound or an epoxy compound, provided that the oxetane compound and the epoxy compound each comprise 2-15 functional groups.

(Structure 6) The electrophotographic photoreceptor of any one of Structures 1-5, wherein the outermost layer comprises inorganic particles.

(Structure 7) The electrophotographic photoreceptor of Structure 6, wherein the inorganic particles comprise titanium oxide or zinc oxide.

(Structure 8) A process cartridge used in an image forming apparatus comprising an electrophotographic photoreceptor; a device of charging the electrophotographic photoreceptor; a device of forming an electrostatic latent image; a developing device to visualize the electrostatic latent image on the electrophotographic photoreceptor; a device of transferring a toner image visualized on the electrophotographic photoreceptor onto a transfer material; and a cleaning device to remove toner remaining on the electrophotographic photoreceptor after the transferring, wherein the electrophotographic photoreceptor of any one of Structures 1-7 equipped with at least one of the charging device, the electrostatic latent image forming device, the developing device, the transferring device and the cleaning device is supported as an integrated unit, and the unit is capable of mounting on the image forming apparatus or removing from the image forming apparatus freely.

(Structure 9) An image forming apparatus comprising an electrophotographic photoreceptor; a device of charging the electrophotographic photoreceptor; a device of forming an electrostatic latent image; a developing device to visualize the electrostatic latent image on the electrophotographic photoreceptor; a device of transferring a toner image visualized on the electrophotographic photoreceptor onto a transfer material; and a cleaning device to remove toner remaining on the electrophotographic photoreceptor after the transferring, wherein the image forming apparatus comprises the electrophotographic photoreceptor of any one of Structures 1-7.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The present invention is further described in detail. An electrophotographic photoreceptor used in an image forming method of the present invention having a photosensitive layer provided on a conductive support, but the photosensitive layer may comprise an intermediate layer, a charge generating layer and a charge transporting layer, which are laminated in this order, provided on the conductive support. Next, these structures each are explained.

(Conductive Support)

Any of supports employed in the present invention is allowed to be usable, provided that any of the supports is conductive. Examples thereof include supports prepared in the form of a drum or a sheet by molding metal such as aluminum, copper, chromium, nickel, zinc or stainless-steel; supports prepared by laminating metal foil such as aluminum or copper on a plastic film; supports prepared by evaporating aluminum, indium oxide, tin oxide or such onto a plastic film; and supports formed from metal, a plastic film or a paper sheet which are prepared by coating a conductive material singly or in combination with a binder resin to provide a conductive layer.

(Intermediate Layer)

In the present invention, a subbing layer with a barrier function and an adhesive function can also be provided between a conductive layer and a photosensitive layer. The subbing layer can be formed from casein, polyvinyl alcohol, cellulose nitrate, ethylene-acrylic acid copolymer, polyamide, polyurethane or gelatin. Of these, alcohol-soluble polyamide is preferable. The subbing layer preferably has a thickness of 0.1-15 μm.

Conductive particles and metal oxides can be contained in the intermediate layer in order to adjust resistance of the intermediate layer. Examples thereof include various metal oxides such as alumina, zinc oxide, titanium oxide, tin oxide, antimony oxide, indium oxide, bismuth oxide and so forth. Particles of tin-doped indium oxide, particles of antimony-doped tin oxide or zirconium oxide and so forth can also be employed. When mixing at least two kinds, a solid solution or a fused material may be allowed to be utilized. Such the metal oxide preferably has an average particle diameter of 0.3 μm or less, and more preferably has an average particle diameter of 0.1 μm or less.

(Charge Generating Layer)

An azo material such as Sudan red or Dian blue, a quinone pigment such as pyrenquinone or anthanthon, a quinocyanine pigment, a perylene pigment, an indigo pigment such as indigo or thioindigo, or a phthalocyanine pigment can be used singly as a charge generating material for a charge generating layer, or be dispersed in a commonly known resin for a charge generating layer. Preferable examples of binder resins include a formal resin, a butyral resin, a silicone resin, a silicone modified butyral resin, a phenoxy resin, polystyrene, polyvinyl acetate and an acrylic resin. A weight ratio of the charge generating material to the binder resin is preferably 20-600 parts by weight with respect to 100 parts by weight of the binder resin. The charge generating layer preferably has a thickness of 5 μm or less, and more preferably has a thickness of 0.05-3 μm. In the case of the thickness of less than 0.05 μm, residual potential tends to increase since insufficient sensitivity can be obtained. On the other hand, in the case of the thickness exceeding 5 μm, dielectric breakdown and black spots are easy be generated. Incidentally, a charge generating layer coating solution obtained via filtration of foreign material and coagulated material before coating can prevent occurrence of image defects. The charge generating layer can also be formed via evaporation of the foregoing pigment.

(Charge Transporting Layer)

A coating material in which a charge transporting material and a binder resin are mainly dissolved in a solution is coated and dried to form a charge transporting layer. Examples of the usable charge transporting material include a triarylamine based compound, a hydrazone compound, a stilbene compound, a pyrazoline based compound, an oxazole based compound, triarylmethane based compound and a thiazole based compound.

These are combined with 0.5-2 times the amount of binder resin, and the resulting was coated and dried to form a charge transporting layer. Examples of the binder resin include polystyrene, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer resin containing at least two of repeating unit structures in these resins. Further, provided is a polymeric organic semiconductor such as poly-N-vinylcarbazole other than these insulating resins.

The charge transporting layer preferably contains an antioxidant. The antioxidant means as a typical material, a material exhibiting a property in which the action of oxygen is prevented or inhibited under the conditions of light, heat, discharge and so forth against an autoxidation material being present in an organic photoreceptor or on the surface of the organic photoreceptor.

The charge transporting layer preferably has a thickness of 10-40 μm, and more preferably has a thickness of 15-30 μm. In the case of the thickness of less than 10 μm, dielectric breakdown and black spots are easy be generated. On the other hand, in the case of the thickness exceeding 40 μm, sharpness is easy to be deteriorated since images are blurred.

Further, in cases where a charge transporting layer is the outermost layer of a photoreceptor, at least a fluorine resin represented by Formula (1) is contained in the charge transporting layer. In Formula (1), each of X, Y and Z independently represents any of a hydrogen atom, a halogen atom, a halogen-substituted alkyl group and a halogen-substituted alkoxy group. At least one of X, Y and Z represents a fluorine atom, and each of $R_4$, $R_5$, $R_6$ and $R_7$ independently represents any of a hydrogen atom, a halogen atom and a halogen-substituted alkyl group, provided that the hydrogen atom is not a fluorine atom. However, repeating units represented by "—CF(X)—CY(Z)-" or "—$CR_4(R_5)$—$CR_6(R_7)$" may be identical or different. With respect to the repeating units being different, in the case of "—CF(X)—CY(Z)-", for example, a plurality of repeating units have different X, Y and Z. X, Y, Z, $R_4$, $R_5$, $R_6$ and $R_7$ each are preferably a hydrogen atom or a halogen atom.

Each of $R_1$, $R_2$, and $R_3$ independently represents any of a hydrogen atom, a halogen atom and a halogen-substituted alkyl group, and at least one of $R_1$, $R_2$, and $R_3$ represents a fluorine atom, but each of $R_1$, $R_2$, and $R_3$ is preferably a hydrogen atom or a halogen atom and a hydrogen atom is specifically preferable.

Symbol n1 represents an integer of 1-8000, preferably represents an integer of 200-6000, and more preferably represents an integer of 300-4000. Symbol n2 also represents an integer of 0-4000, preferably represents an integer of 200-3000, and more preferably represents an integer of 300-2000.

A fluorine resin represented by Formula (1) of the present invention preferably has an average primary particle diameter of at least 0.10 μm but less than 1.50 μm, and more preferably has an average primary particle diameter of at least 0.15 μm but less than 1.30 μm. In the case of the average primary particle diameter of at least 0.10 μm but less than 1.50 μm, a layer is easy to be coated because of excellent dispersibility, and excellent properties can also be obtained because of less influence of exposure scattering during image formation.

In addition, the average primary particle diameter is specifically measured by the following method.

Particles are micrographed at a magnification of 10000 times employing a scanning electron microscope to take photographic images into a scanner. Particles in the photographic images are processed via binarization employing an image processing analyzer (Luzex AP, manufactured by Nireco Corporation, and 50 particles are measured to determine a horizontal particle diameter of each particle. the obtained mean value is designated as the average primary particle diameter.

Conventional fluorine resins are produced by various methods. Examples thereof include a telomerization method of tetrafluoroethylene (TFE), a pyrolytically decomposing method, a decomposing method via exposure to X-ray or -ray, and a forming method via vapor phase dispersion to produce polytetrafluoroethylene (PTFE).

However, in the case of the telomerization method and the pyrolytically decomposing method, it is difficult to be fluorinated at the terminal like a fluorine resin represented in foregoing Formula (1), since a high hydrophilic structure such as a hydroxyl group and a carboxylic acid is produced at the terminal due to manufacturing reasons, whereby the forming method via vapor phase dispersion is preferred.

Specifically, the forming method via vapor phase dispersion is a preparation method in which a fluorine resin is heated to at least the melting point for gasification, and the gas and a fluorination material are contact-reacted.

Examples of the supplied fluorination material include compounds of molecular fluorine, nitrogen trifluoride, chlorine trifluoride, bromine trifluoride, iodine trifluoride and krypton fluoride. The fluoride is a fluorination material by which a fluorine radical is generated, and the fluorine radical is capable of breaking the main chain of the fluorine resin, and of coupling and stabilizing the radical at the terminal of the resulting low molecular material for smooth reaction. Therefore, the reaction product is fluorinated at the terminal because of decomposition in the presence of the active fluorine radical, and very stable.

In the case of containing a fluorine resin represented by foregoing Formula (1) in a charge transporting layer, friction factor is more effectively reduced, and excellent lubricity can be held because of fluorination at the terminal. The reduction of effective friction factor and holding of the excellent lubricity depend on fluorine resin particles exposed on the surface of a photoreceptor. Thus, the fluorine resin may be contained above the film thickness in which a function can not serve as an electrophotographic photoreceptor any longer because of charge transporting layer wear caused by repetitive use, but in the case of containing the fluorine resin particles in the inside, they are to be wasted, whereby electrophotographic properties of the photoreceptor, on the contrary, is possible to be deteriorated. For example, a method of manufacturing an electrophotographic photoreceptor to contain a lot of fluorine resin particles around the charge transporting layer surface is preferably a method of coating a coating solution to form a charge transporting layer containing fluorine resin particles after coating a coating solution to form a charge transporting layer containing no fluorine resin particles.

One example is specifically described. The first charge transporting layer is formed employing a charge transporting layer containing no fluorine resin particles, and the second charge transporting layer is formed thereon employing a coating solution to form a charge transporting layer in which the content of fluorine resin particles is 60% by weight, based on the weight of binder resin, followed by a drying process to form a charge transporting layer containing a lot of fluorine resin particles on the surface.

Fluorine resins of the present invention are those represented by foregoing Formula (1). Examples thereof include polytetrafluoroethylene (PTFE), polyvinylidene fluoride (PVDF), tetrafluoroethylene-per-fluoroalkoxyethylene copolymer (PFA), polychlorotrifluoroethylene (PCTFE), polyvinyl fluoride (PVF) and so forth.

The content of fluorine resin in the outermost layer is preferably 10-100% by weight, based on the weight of binder resin. In the case of the content of less than 10% by weight, a projected area ratio of particles exposed on the surface becomes small and a low friction factor effect can not be obtained sufficiently, whereby peeling of a cleaning blade tends to be generated, and in the case of the content exceeding 100% by weight, the content of binder resin inevitably becomes small, whereby mechanical strength of a coated layer is presumably lowered.

A photoreceptor of the present invention may also contain particles other than fluorine resin particles in a charge transporting layer, provided that the charge transporting layer is the outermost layer.

Particles are broadly classified into organic particles and inorganic particles. Examples of organic particles include silicone resin powder, a-carbon powder and so forth other than fluorine resin particles. Examples of inorganic particles include metal powder such as copper, tin, aluminum or indium; metal oxide such as silica, tin oxide, zinc oxide, titanium oxide, alumina, indium oxide, antimony oxide, bismuth oxide, calcium oxide, antimony-doped tin oxide or tin-doped indium oxide; metal fluoride such as tin fluoride, calcium fluoride or aluminum fluoride; potassium titanate; boron nitride and so forth.

Various additives can be added in a photoreceptor containing these particles in order to improve dispersibility and smoothness of particles. Specifically, in view of improving the dispersibility, a surface treatment of particles is largely effective. Examples of the surface-treating agent include various inorganic materials, silicon compounds, a fluorine-containing silane coupling agent, fluorine modified silicone oil, a fluorine-containing surfactant, a fluorine based graft polymer and so forth.

Inorganic particles are capable of improving wear resistance of the outermost layer of a photoreceptote, since inorganic particles have higher hardness than that of organic particles. However, it is known that generally, the surface portion of a latent image carrier is not worn away when wear resistance of the latent image carrier is improved, but low resistance is produced at the surface portion by reaction gas such as ozone, $NO_X$ or such generated during electrification, and static charge at the surface portion has not gradually been held, whereby the static charge is to be moved in the surface direction. As the result, an electrostatic latent image blurs, and an anomalous image called image blur observed when the electrostatic latent image is developed with toner or such is to be produced. In this case, particles utilized in the present invention preferably have a resistance of at least $10^{10}$ Ωcm. Lower resistance of the outermost surface of a photoreceptor is inhibited by employing such the inorganic particles, and occurrence of the above-described anomalous image is largely prevented.

Of these inorganic particles, silica, titanium oxide and zinc oxide are effectively usable. Among these, titanium oxide and zinc oxide exhibiting high insulating property together with a high dielectric constant are specifically usable in view of prevention of image blur, improved wear resistance and electrical properties. Such the inorganic particles may be used singly or in combination with at least two kinds.

These inorganic particles can be dispersed with a charge transporting material, a binder resin and a solvent employing a homogenizer. Inorganic particles preferably have an average primary particle diameter of 0.3 μm or less, and more preferably have an average primary particle diameter of 0.1 μm or less.

The content of inorganic particles in a surface layer, depending on kinds of employed particles and the conditions of the electrophotographic process with a photoreceptor, is preferably 20-150% by weight. These inorganic particles can be contained in the entire charge transporting layer, but preferable is a structure in which a concentration gradient is provided in such a way that since the exposure portion potential tends to become high, the content of inorganic particles is high on the outermost layer side of the charge transporting layer, and low on the conductive support side, or the content of inorganic particles grows gradually higher toward the surface side from the conductive support by preparing a plurality of charge transporting layers.

In a photoreceptor of the present invention, preferable is a structure in which a protective layer is provided on a photosensitive layer. A protective layer is provided to improve wear resistance or to provide a function of lubricity.

(Protective Layer)

When a protective layer is used in a photoreceptor of the present invention, a fluorine resin represented by foregoing Formula (1) of the present invention is contained in the protective layer since the protective layer is the outermost layer.

The fluorine resin represented by Formula (1) of the present invention preferably has an average primary particle diameter of at least 0.10 μm but less than 1.50 μm, and more preferably has an average primary particle diameter of at least 0.15 μm but less than 1.30 μm.

In the present invention, since light curing resins are utilized, and cured via cross-linkage, low friction factor is maintained even in repetitive use for a long duration, and wear resistance is also improved. Further, influence of the photoreceptor to electrical properties is comparatively small, and the larger content can be increased than in the case of containing a fluorine resin in the charge transporting layer since the protective layer provided on a photosensitive layer has a thin thickness. Thus, there is the advantage of being able to separate the function from the charge transporting layer by using formulation specified to realization of low friction factor and wear resistance.

There is a compound having a cationic or radical polymerization functional group as a light curing resin. The compound having a cationic polymerization functional group makes a compound (acid generator) of starting cationic polymerization via exposure to activation energy radiation to generate acid, and polymerization is initiated. Various cationic polymerization monomers are usable as the compound having a cationic polymerization functional group. Examples thereof include an epoxy compound, a vinyl ether compound, an oxetane compound and so forth, but an oxetane compound and an epoxy compound are specifically preferable. The compound having a cationic polymerization functional group comprises an oxetane compound or an epoxy compound, and the oxetane compound and the epoxy compound each preferably have 2-15 functional groups, and more preferably have 3-12 functional groups. Specific examples of most readily curable radical polymerization compounds include monomers and oligomers having an acrylate group or a methacrylate group.

A protective layer of the present invention is preferably an activation energy radiation cationic reaction curable film formed from a cationic polymerization compound and a compound to start cationic polymerization via exposure to activation energy radiation, and the compound to start cationic polymerization is preferably a nonionic compound.

The cationic polymerization exhibits specifically excellent surface curing, since unlike radical polymerization, cationic polymerization is not inhibited by oxygen, and mechanical strength is further improved by containing particles. At the same time, high transfer and easy cleaning properties can be realized.

Since an oxetane compound among cationic polymerization compounds specifically exhibits high speed reaction and formation of high molecular weight, an amount of hydroxyl group in a cured material is small, and the cured material depends hardly on the environment.

An acid generator having a commonly known salt structure (thermal stability is generally lower than that of a nonionic compound) generates a lot of acid by decomposing via aging. When acid is produced in a dispersion, and the balance between a monomer (cationic polymerization compound) and particles is lost, particles are presumably coagulated. Thus, a nonionic acid generator by which acid is generated for the first time during exposure to activation energy radiation is effective for film formation, and longer life with respect to pot life of the liquid is to be realized.

As the compound to start cationic polymerization via exposure to activation energy radiation, for example, compounds used for a chemical amplification type photo resist or a light cationic polymerization are utilized (Organic Electronics Material Workshop "Organic material for imaging" from Bunshin publishing house (1993), refer to page 187-192).

For example, listed are $B(C_6F_5)_4^-$, $PF_6^-$, $AsF_6^-$, $SbF_6^-$, $CF_3SO_3^-$ salt of an aromatic onium compound such as a diazonium compound, an ammonium compound, an iodonium compound, a sulfonium compound, or a phosphonium compound, a sulfonated material to generate a sulfonic acid, a halide to generate hydrogen halide, iron-arene complex or such.

However, the compound having a salt structure produces several problems as described above. A nonionic compound to start cationic polymerization via exposure to activation energy radiation in the present invention (also referred to simply as nonionic compound) is a compound to generate acid via exposure to activation energy radiation, and a neutral compound before exposure to activation energy radiation. As described above, a sulfonated material to generate a sulfonic acid and a halide to generate hydrogen halide are preferable. A compounds to generate a perfluorosulfonic acid as a super strong acid is preferable.

Specific examples of halide to generate hydrogen halide as a nonionic compound of the present invention include trihalogen substitution-1,3,5-triazines. Commercially available products are TAZ-101, TAZ-102, TAZ-103, TAZ-203 and TAZ-204, produced by Midori Kagaku Co., Ltd., and TFE triazine and TME triazine, produced by Sanwa Chemical Co., Ltd. A sulfonated material to generate a sulfonic acid is also commercially available, and examples thereof include T1188 and P1377, produced by Tokyo Chemical Industry Co., Ltd.; CTPAG produced by Eiweiss Chemical Corporation; and PAI-01, PAI-101, PAI-106, PAI-1001, NAI-100, NAI-101, NAI-105, NAI-106, NAI-109, NAI-1002, NAI-1003, NAI-1004, NDI-101, NDI-105, NDI-106, NDI-109, SI-101, SI-105, SI-106, SI-109, PI-105, PI-106 and PI-109, produced by Midori Kagaku Co., Ltd. CTPAG, NAI-105, NDI-105, SI-105 and PI-105, in which super strong acid is generated, are preferable. Further, CTPAG is more preferable.

The protective layer of the present invention is preferably formed from a reaction-curing film of a compound having a cationic polymerization functional group, as described above. Various commonly known cationic polymerizable polymers are used as the compound having a cationic polymerization functional group. Examples thereof include an epoxy compound, a vinylether compound and an oxetane compound, disclosed in Japanese Patent O.P.I. Publication 6-9714, Japanese Patent O.P.I. Publication 2001-31892, Japanese Patent O.P.I. Publication 2001-40068, Japanese Patent O.P.I. Publication 2001-55507, Japanese Patent O.P.I. Publication 2001-310938, Japanese Patent O.P.I. Publication 2001-310937 and Japanese Patent O.P.I. Publication 2001-220526, but an oxetane compound is preferable.

The oxetane compound of the present invention is preferably a compound represented by the following Formula (3).

Formula (3)

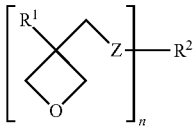

In Formula (3), $R^1$ represents a hydrogen atom, an alkyl group having 1-6 carbon atoms such as a methyl group, an ethyl group, a propyl group or a butyl group, a fluoroalkyl group having 1-6 carbon atoms, an allyl group, an aryl group, a furyl group or a thienyl group; $R^2$ represents an alkyl group having 1-6 carbon atoms such as a methyl group, an ethyl group, a propyl group or a butyl group, an alkenyl group having 2-6 carbon atoms such as a 1-propenyl group, a 2-propenyl group, a 2-methyl-1-propenyl group, a 2-methyl-2-propenyl group, a 1-butenyl group, a 2-butenyl group or a 3-butenyl group; a group having an aromatic group such as a phenyl group, a benzyl group, a fluorobenzyl group, a methoxybenzyl group or a phenoxyethyl group; an alkylcarbonyl group having 2-6 carbon atoms such as an ethylcarbonyl group, a propylcarbonyl group or a butylcarbonyl group; an alkoxycarbonyl group having 2-6 carbon atoms such as an ethoxycarbonyl group, a propoxycarbonyl group, a butoxycarbonyl group; or an N-alkylcarbamoyl group having 2-6 carbon atoms such as an ethylcarbamoyl group, a propylcarbamoyl group, a butylcarbamoyl group or a pentylcarbamoyl group. Z represents oxygen or sulfur, and n represents an integer of 2-100.

The above compound represented by Formula (3) is commercially available. Examples thereof include OXT-101, OXT-121, OXT-221, OXT-212, OXT-211 and so forth, produced by Toagosei Co., Ltd. Other examples include 3-ethyl-3-(cyclohexyoxy) methyloxetane, oxetanyl silsesquioxane, oxetanyl silicate, phenol novolak oxetane and 1,3-bis[(1,3-ethyloxetane-3-yl) methoxy]benzene. Preferable is an oxetane compound having 2-20 functional groups such as OXT-121, OXT-221, oxetanyl silicate, phenol novolak oxetane or 1,3-bis[(1,3-ethyloxetane-3-yl) methoxy]benzene. More preferable is phenol novolak oxetane.

Specific examples of the preferable oxetane compound are shown below, but the present invention is not limited thereto.

Compound 1

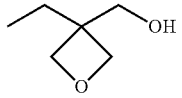

Compound 2

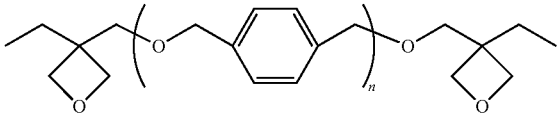

n = 1 ~ 3

Compound 3

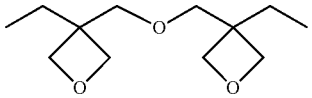

Compound 4

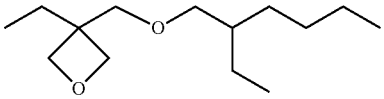

Compound 5

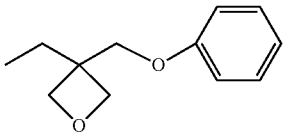

Compound 6

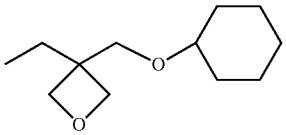

Compound 7

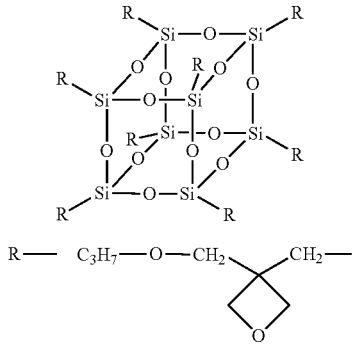

Compound 8

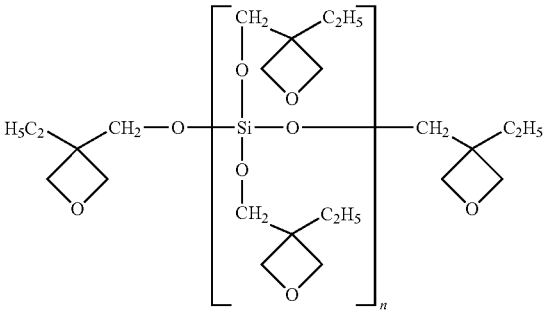

n = 5(Ave)

-continued

Compound 9

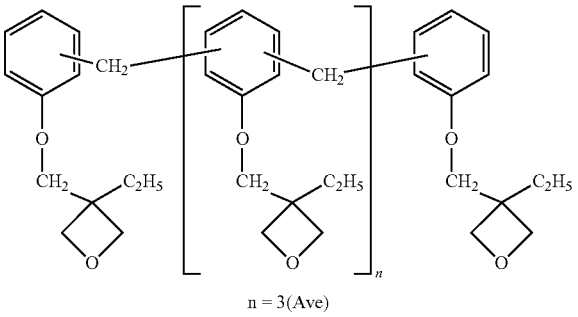

n = 3(Ave)

Compound 10

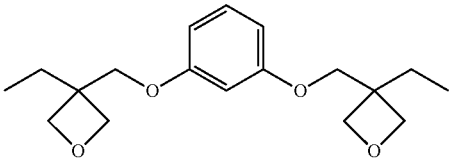

Compound 11

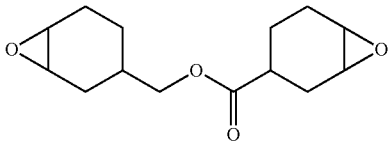

Compound 12

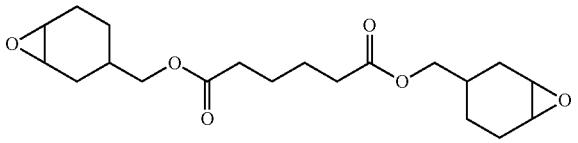

Compound 13

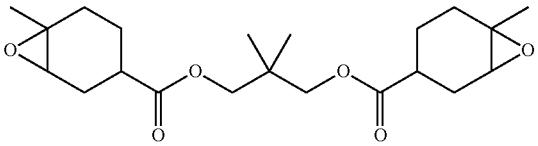

Compound 14

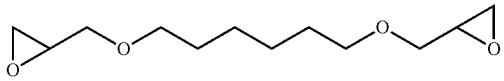

Compound 15

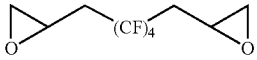

Compound 16

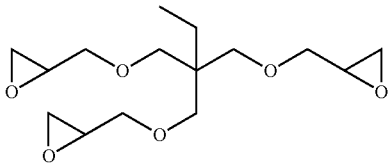

Examples of the epoxy compound include aromatic epoxide, alicyclic epoxide and aliphatic epoxide.

Preferable one as aromatic epoxide is di or polyglycidyl ether prepared via reaction of epichlorohydrin with polyhydric phenol having at least one aromatic nucleus or an alkylene oxide adduct thereof. Examples thereof include di or polyglycidyl ether of bisphenol A or an alkylene oxide adduct thereof; di or polyglycidyl ether of hydrogen-added bisphenol A or an alkylene oxide adduct thereof; a novolak type epoxy resin and so forth, provided that alkylene oxide is ethyleneoxide, propylene oxide or such.

As the alicyclic epoxide, preferable are compounds containing cyclohexene oxide or cyclopentene oxide, which are prepared by epoxidizing a compound having at least one cycloalkane ring such as a cyclohexene or cyclopentene ring and so forth with an appropriate oxidant such as hydrogen peroxide or a peroxy acid.

Preferable one as aliphatic epoxide is di or polyglycidyl ether of aliphatic polyhydric alcohol or an alkylene oxide adduct thereof. Examples thereof include diglycidyl ether of alkylene glycol such as diglycidyl ether of ethylene glycol, diglycidyl ether of propylene glycol or diglycidyl ether of 1,6-hexanediol; polyglycidyl ether of polyhydric alcohol such as di or triglycidyl ether of glycerin or an alkylene oxide adduct thereof; diglycidyl ether of polyalkylene glycol such as diglycidyl ether of polyethylene glycol or an alkylene oxide adduct thereof, or diglycidyl ether of polypropylene glycol or an alkylene oxide adduct thereof; and so forth, provided that alkylene oxide is ethyleneoxide, propylene oxide or such.

Examples of vinylether compounds include a di or trivinyl ether compound such as ethylene glycol divinylether, diethylene glycol divinylether, triethylene glycol divinylether, propylene glycol divinylether, dipropylene glycol divinylether, butanediol divinylether, hexane diol divinylether, cyclohexane dimethanol divinylether or trimethylol propane trivinylether; and a monovinylether compound such as ethyl vinylether, n-butyl vinylether, isobutyl vinylether, octadecyl vinylether, cyclohexyl vinylether, hydroxybutyl vinylether, 2-ethylhexyl vinylether, cyclohexanedimethanol monovinylether, n-propyl vinylether, isopropyl vinylether, isopropenyl ether-O-propylene carbonate, dodecyl vinylether, diethylene glycol monovinylether or octadecyl vinylether.

The protective layer may also contain organic particles and inorganic particles in order to further provide wear resistance. As the particles, those described above, including conventional fluorine resin particles, are usable. These particles are also used singly or in combination with at least two kind.

The content of the above-described organic particles {including fluorine resin particles represented by Formula (1)} is preferably 10-100% by weight, based on the weight of cationic polymerization compound, and more preferably 20-80% by weight. The content of inorganic particles is preferably 20-150% by weight, based on the weight of cationic polymerization compound, and more preferably 30-130% by weight.

In the case of organic particles having a content of less than 10% by weight, the projected area ratio of particles exposed on the surface becomes small, whereby the effect of low friction factor can not be sufficiently produced, and peeling of a cleaning blade tends to be generated. On the other hand, in the case of organic particles having a content exceeding 100% by weight, a binder content becomes inevitably small, whereby mechanical strength of the coated layer is presumably lowered.

In the case of inorganic particles having a content of less than 20% by weight, resistance of the surface layer becomes too large, which causes increase of the residual potential and occurrence of fog. On the other hand, in the case of inorganic particles having a content exceeding 150% by weight, film forming performance is deteriorated, which frequently causes a decline of charging ability, occurrence of cleaning trouble and a decline of mechanical strength.

Next, an image forming apparatus employing a contact electrification system of the present invention will be explained.

FIG. 1 is a schematic cross-sectional view of image forming apparatus 1 employing a contact electrification system of the present invention. Image forming apparatus 1 has therein photoreceptor cartridge 2, developing cartridge 3, exposure device 4 that emits a laser beam modulated based on image signals coming from the outside, while deflecting the laser beam, sheet feeding device 5 that feeds a recording sheet, transfer roller 6, fixing device 7 and sheet ejection tray 8.

Photoreceptor cartridge 2 is provided therein with photoreceptor 21 that is made by forming a thin film layer of organic photoconductive material on an outer circumferential surface of a cylindrical body, and with charging brush 22. Developing cartridge 3 is provided therein with an unillustrated developing sleeve, a stirring roller, and with a toner tank wherein toner and carrier are housed, and developing bias is impressed on the developing sleeve from an unillustrated developing power supply. For preventing generation of troubles caused by mechanical contact in the case of mounting cartridges on or removing them from image forming apparatus 1, each of both cartridges is provided with an unillustrated protective cover that is closed in the case of insertion into image forming apparatus 1 and is opened in the case of removing from image forming apparatus 1.

Since the image forming process is widely known, it will be shown simply as follows. First, a surface of photoreceptor 21 is charged evenly with prescribed voltage by charging brush 22. Exposure unit 4 generates modulated laser beam (that is shown with an arrow of a broken line), then, this laser beam is deflected by an unillustrated polygon mirror for deflection scanning on photoreceptor 21, thus, electrostatic latent images corresponding to image information are formed on the charged surface in succession. Toner housed in a toner tank is supplied onto the developing sleeve after being stirred by the stirring roller, and forms a toner image corresponding to the electrostatic latent image at a portion facing photoreceptor 21. Simultaneously, residual toner remaining on the unexposed portion (non-image portion) on the surface of photoreceptor 21 is collected in the developing cartridge, by using the voltage difference between developing bias voltage to be impressed on the developing sleeve and surface voltage of the photoreceptor 21. On the other hand, a toner image is transferred onto a recording sheet on an electrostatic basis by transfer roller 6 arranged to face the photoreceptor 21. Incidentally, a recording sheet is brought from sheet feeding device 5 along a conveyance path shown with an arrow of solid line in the drawing. Then, this recording sheet is conveyed to fixing device 7 where unfixed toner image is fixed on the recording sheet through heat fixing. Finally, the recording sheet on which aimed images are formed is ejected to sheet ejection tray 8. Thus, many duplicates of a document can be made at high speed, by repeating the aforementioned series of process.

The charging brush stirs mechanically residual toner conveyed by rotation of the photoreceptor to the contact portion between the photoreceptor and the charging brush, and diffuses it on the surface of the photoreceptor until the moment when the residual toner becomes unreadable. Further, the charging brush absorbs residual toner having polarity opposite to that of electrification polarity of the photoreceptor (reverse polarity) on an electrostatic basis, to collect it, and charges it to be of the same polarity (regular polarity) as the electrification polarity of the photoreceptor to discharge on the photoreceptor surface.

Figure 2:
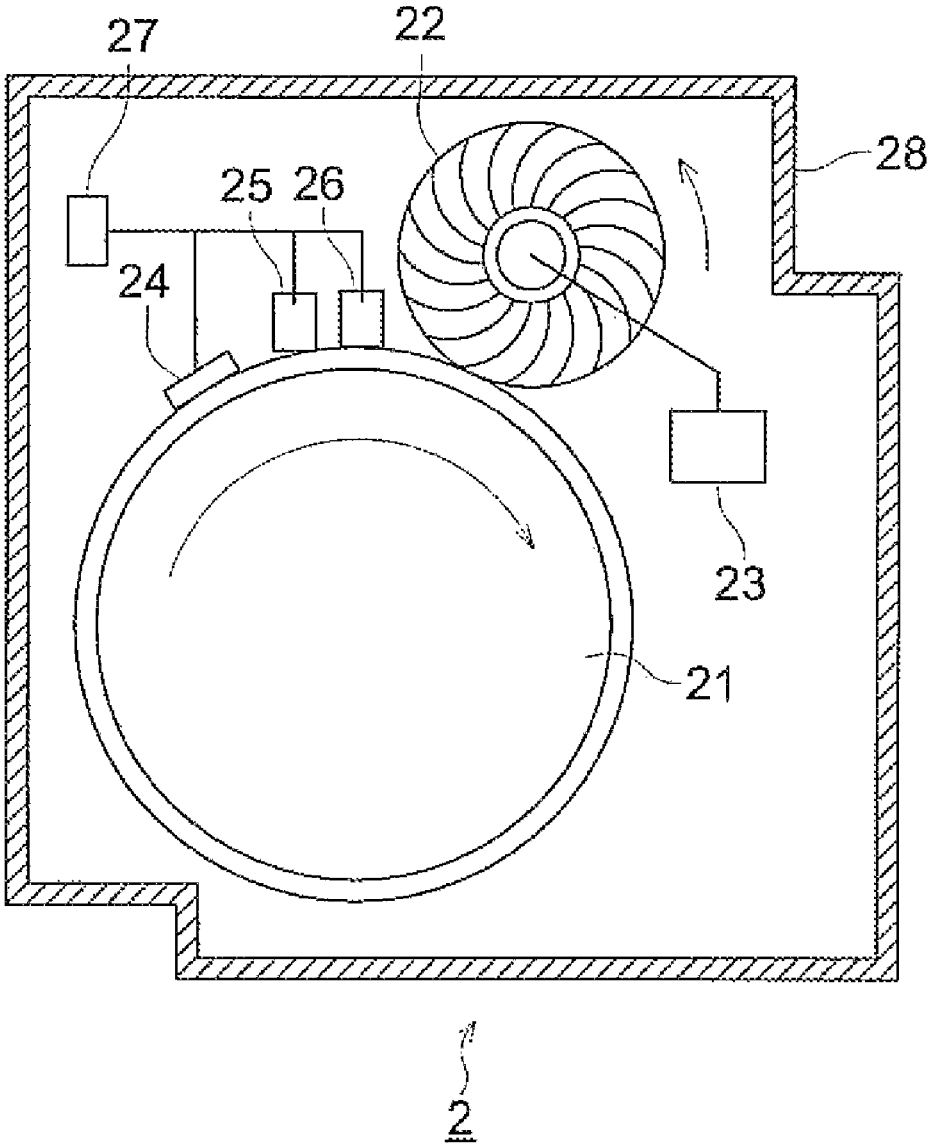
FIG. 2 is a schematic cross-sectional view of a photoreceptor cartridge capable of freely mounting on or removing from an image forming apparatus.

FIG. 2 is a schematic cross-sectional view of photoreceptor cartridge 2 capable of freely mounting on or removing from image forming apparatus 1. In casing 28 with a protective cover of photoreceptor cartridge 2, there are provided photoreceptor 21 representing an image carrier, charging brush 22 arranged around photoconductor 21 to be in contact therewith, power supply connection member 23 for impressing prescribed voltage on charging brush 22, pre-charging film 24, charging shakedown members (sponge-shaped charging members) 25 and 26 and power supply connection member 27.

Photoconductor 21 is rotated by an unillustrated driving apparatus in the direction of an arrow in the drawing. Charging brush 22 is one wherein conductive bristles composed of capillary fibers are flocked on a brush support. This charging brush 22 is rotated by an unillustrated driving device in the direction of an arrow in the drawing, under the condition that the charging brush is in contact with the surface of photoreceptor 21, namely, it is rotated in the same direction as that of photoreceptor 21 in the portion of contact between photoreceptor 21 and charging brush 22. In the course of image forming, voltage is applied onto charging brush 22 by an unillustrated power supply, whereby, the surface of photoreceptor 21 is charged evenly to be in the prescribed polarity. On the other hand, in the course of non-image forming, voltage having polarity that is opposite to that in the image forming is applied onto charging brush 22 by a power supply for charging. Incidentally, charged polarity of toner is the same as polarity of charging voltage in the image forming. Therefore, toner accumulated in charging brush 22 in the course of non-image forming can be discharged on photoreceptor 21 by electrostatic repelling power.

Development-pre-charging film 24 and charging shakedown members 25 and 26 are arranged to make up for charging unevenness caused by charging brush 22.

Incidentally, though the monochromatic laser printer is shown in the image forming apparatus stated above, it can also be applied to a color laser printer and to a color copying machine. Further, a light source other than a laser, for example, an LED light source may also be used as an exposure light source.

In addition, a cleaner-less image forming apparatus was exemplified for the foregoing image forming apparatus, but it may be an image forming apparatus equipped with a cleaning device only for collection the residual toner. That is, the present invention can also apply for a non cleaner-less image forming apparatus. Further, the organic photoreceptor of the present invention may be utilized with a non-contact charging device (corona charging device and the like) as a charging device.

Further, as a full color image forming apparatus, an embodiment of an electophotographic printer (hereinafter, referred to simply as printer) will be described.

Figure 3:
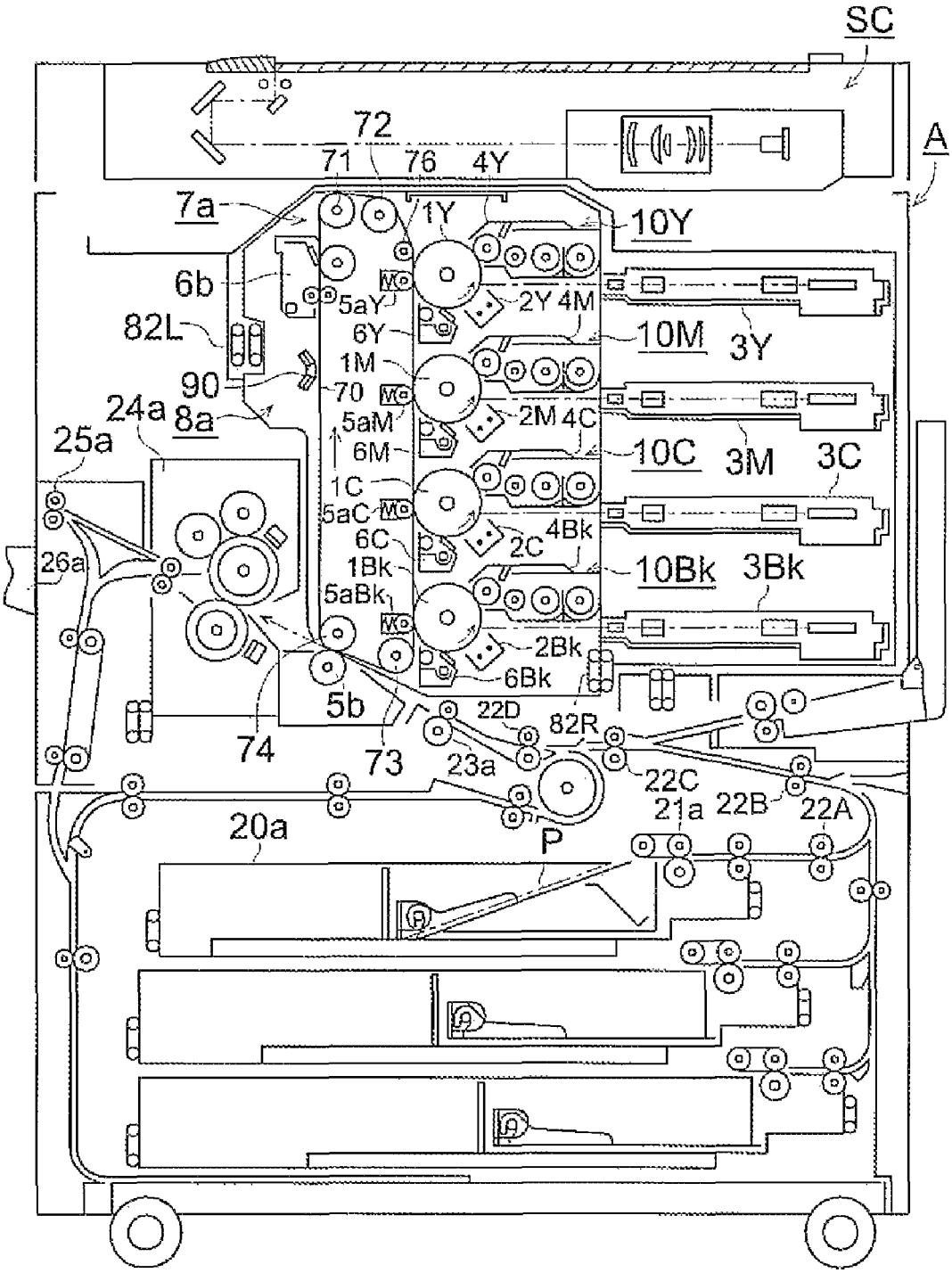
FIG. 3 is a cross-sectional configuration diagram of a color image forming apparatus showing an embodiment of the present invention.

FIG. 3 is a cross-sectional configuration diagram of a color image forming apparatus showing an embodiment of the present invention.

This color image forming apparatus is a so called tandem type color image forming apparatus, and comprises four sets of image forming sections (image forming units) 10Y, 10M, 10C, and 10Bk, endless belt shaped intermediate image transfer body unit 7*a*, sheet feeding and transportation device 21*a*, and fixing device 24*a*. The original document reading apparatus SC is placed on top of main unit A of the image forming apparatus.

Image forming section 10Y that forms images of yellow color comprises charging device 2Y, exposing device 3Y, developing device 4Y, primary transfer roller 5*a*Y as primary transfer section, and cleaning means 6Y all placed around drum shaped photoreceptor 1Y which acts as the first image supporting body. Image forming section 10M that forms images of magenta color comprises drum shaped photoreceptor 1M which acts as the first image supporting body, charging device 2M, exposing device 3M, developing device 4M, primary transfer roller 5*a*M as a primary transfer section, and cleaning device 6M. Image forming section 10C that forms images of cyan color comprises drum shaped photoreceptor 1C which acts as the first image supporting body, charging device 2C, exposure device 3C, developing device 4C, primary transfer roller 5*a*C as a primary transfer section, and cleaning device 6C. Image forming section 10Bk that forms images of black color comprises drum shaped photoreceptor 1Bk which acts as the first image supporting body, charging device 2Bk, exposing device 3Bk, developing device 4Bk, primary transfer roller 5*a*Bk as a primary transfer section, and cleaning device 6Bk.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image exposing devices 3Y, 3M, 3C, and 3Bk, rotating developing devices 4Y, 4M, 4C, and 4Bk, and cleaning devices 5*a*Y, 5*a*M, 5*a*C, and 5*a*Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has placed around photoreceptor drum 1Y which is the image forming body, charging device 2Y (hereinafter referred to simply as charging device 2Y or charger 2Y), exposing device 3Y, developing device 4Y, and cleaning device 5*a*Y (hereinafter referred to simply as cleaning device 5*a*Y or cleaning blade 5*a*Y), and forms yellow (Y) colored toner image on photoreceptor drum 1Y. Further, in the present preferred embodiment, at least photoreceptor drum 1Y, charging device 2Y, developing device 4Y, and cleaning device 5*a*Y in image forming unit 10Y are provided in an integral manner.

Charging device 2Y is a means that applies a uniform electrostatic potential to photoreceptor drum 1Y, and corona discharge type charger 2Y is being used for photoreceptor drum 1Y in the present embodiment.

Image exposing device 3Y is a means that carries out light exposure, based on the image signal (Yellow), on photoreceptor drum 1Y to which a uniform potential has been applied by charging device 2Y, and forms the electrostatic latent image corresponding to the yellow color image, and an array of light emitting devices LEDs and imaging elements (product name: SELFOC LENSES) arranged in the axial direction of photoreceptor drum 1Y or a laser optical system, etc., is used as exposing device 3Y.

In the image formation method of the present invention, when an electrostatic latent image is formed on the photoreceptor, exposure beam having a spot area of 2000 $\mu m^2$ or less is preferably utilized for imagewise exposure. Even though such the small spot beam exposure is carried out, an organic photoreceptor of the present invention can form images corresponding to the spot area precisely. A spot area of 100-1000 $\mu m^2$ is more preferable. As the result, in the case of a resolution of at least 800 dpi (dpi: the number of dots per 25.4 cm), electrophotographic images exhibiting high gradation can be obtained.

The spot area of the exposure beam means the area corresponding to a region of $1/e^2$ of the maximum peak light intensity on a light intensity distribution plane appearing on the cut surface, when cutting is conducted in the plane parallel to the exposure beam plane.

The exposure beam to be used includes the beams of the scanning optical system using the semiconductor laser and solid scanner such as an LED and the like. The distribution of the light intensity includes gauss distribution and Lorenz distribution. The portion up to $1/e^2$ of each peak intensity is designated as a spot area.

Intermediate image transfer body unit 7*a* in the shape of an endless belt is wound around a plurality of rollers, and has endless belt shaped intermediate image transfer body 70 (transfer medium) which acts as the second image carrier in the shape of a partially conducting endless belt which is supported in a free manner to rotate.

The images of different colors formed by image forming units 10Y, 10M, 10C, and 10Bk, are successively transferred onto rotating endless belt shaped intermediate image transfer body 70 by primary transfer rollers 5*a*Y, 5*a*M, 5*a*C, and 5*a*Bk acting as the primary image transfer section, thereby forming the synthesized color image. Transfer material (transfer medium) P as the transfer material stored inside sheet feeding cassette 20*a* (the supporting body that carries the final fixed image: for example, plain paper, transparent sheet, etc.) is fed from sheet feeding device 21*a*, pass through a plurality of intermediate rollers 22A, 22B, 22C, and 22D, and resist roller 23*a*, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24*a*, and is gripped by sheet discharge rollers 25*a* and placed above sheet discharge tray 26*a* outside the equipment. Here, the transfer medium means a transfer medium of a toner image on a photoreceptor such as an intermediate transfer body or a transfer material.

On the other hand, after the color image is transferred to transfer material P by secondary transfer roller 5*b* functioning as the secondary transfer section, endless belt shaped intermediate image transfer body 70 from which transfer material P has been separated due to different radii of curvature is cleaned by cleaning device 6*b* to remove residual toner on it.

During image forming, primary transfer roller 5*a*Bk is at all times contacting against photoreceptor 1Bk. Other primary transfer rollers 5*a*Y, 5*a*M, and 5*a*C come into contact respectively with corresponding photoreceptors 1Y, 1M, and 1C only during color image forming.

Secondary transfer roller 5*b* comes into contact with endless belt shaped intermediate transfer body 70 only when secondary transfer is to be made by passing transfer material P through this.

Further, chassis 8*a* can be pulled out via supporting rails 82L and 82R from body A of the apparatus.

Chassis 8*a* comprises image forming sections 10Y, 10M, 10C, and 10Bk, and endless belt shaped intermediate image transfer body unit 7*a*.

Image forming sections 10Y, 10M, 10C, and 10Bk are arranged in column in the vertical direction. Endless belt shaped intermediate image transfer body unit 7*a* is placed to the left side in the figure of photoreceptors 1Y, 1M, 1C, and 1Bk. Endless belt shaped intermediate image transfer body unit 7*a* comprises endless belt shaped intermediate image transfer body 70 that can rotate around rollers 71, 72, 73, and 74, primary image transfer rollers 5*a*Y, 5*a*M, 5*a*C, and 5*a*Bk, and cleaning means 6*b*.

Figure 4:
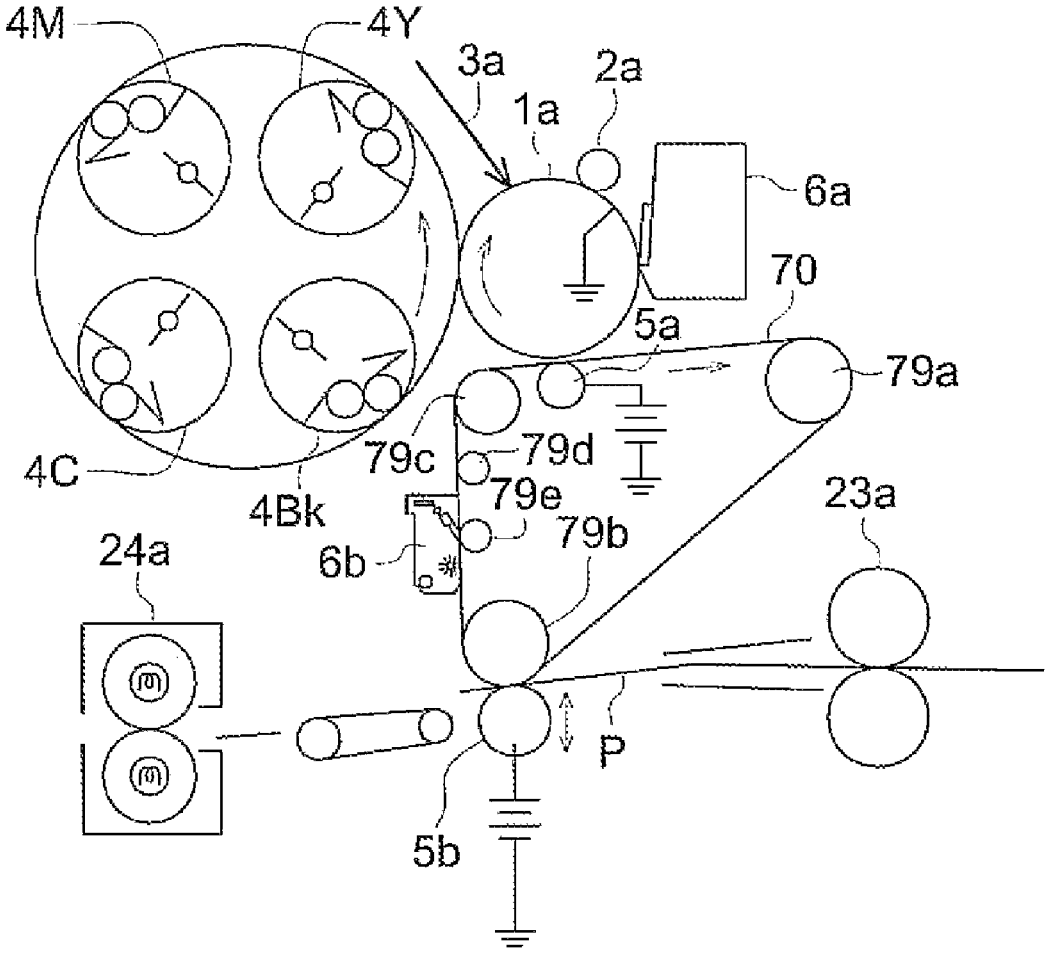
FIG. 4 is a cross-sectional configuration diagram of a color image forming apparatus using an organic photoreceptor of the present invention.

Next, FIG. 4 shows the cross-sectional configuration diagram of a color image forming apparatus using an organic photoreceptor of the present invention (a copier or a laser beam printer having at least a charging device, an exposing device, a plurality of developing devices, image transfer section, cleaning device, and intermediate image transfer body around the organic photoreceptor). An elastic material with a medium level of electrical resistivity is being used for belt shaped intermediate image transfer body 70.

In this figure, 1*a* is a rotating drum type photoreceptor that is used repetitively as the image carrying body, and is driven to rotate with a specific circumferential velocity in the anti-clockwise direction shown by the arrow.

During rotation, photoreceptor 1*a* is charged uniformly to a specific polarity and potential by charging device 2*a*, after which it receives from image exposing device 3*a* not shown in the figure image exposure by the scanning exposure light from a laser beam modulated according to the time-serial electrical digital pixel signal of the image information thereby forming the electrostatic latent image corresponding to yellow (Y) color component of the target color image.

Next, this electrostatic latent image is developed by yellow (Y) developing device: developing process (yellow color developer) 4Y using the yellow toner which is the first color. At this time, the second to the fourth developing device (magenta color developer, cyan color developer, and black color developer) 4M, 4C, and 4Bk are each in the operation switched-off state and do not act on photoreceptor 1*a*, and the yellow toner image of the above first color does not get affected by the above second to fourth developers.

Intermediate image transfer body 70 is wound over rollers 79*a*, 79*b*, 79*c*, 79*d*, and 79*e* and is driven to rotate in a clockwise direction with the same circumferential speed as photoreceptor 1*a*.

The yellow toner image of the first color formed and retained on photoreceptor 1*a* is, in the process of passing through the nip section between photoreceptor 1*a* and intermediate image transfer body 70, intermediate transferred (primary transferred) successively to the outer peripheral surface of intermediate image transfer body 70 due to the electric field formed by the primary transfer bias voltage applied from primary transfer roller 5*a* to intermediate image transfer body 70.

The surface of photoreceptor 1*a* after it has completed the transfer of the first color yellow toner image to intermediate image transfer body 70 is cleaned by cleaning section 6*a*.

In the following, in a manner similar to the above, the second color magenta toner image, the third color cyan toner image, and the fourth color black toner image are transferred successively onto intermediate image transfer body 70 in a superimposing manner, thereby forming the superimposed color toner image corresponding to the desired color image.

Secondary transfer roller 5*b* is placed so that it is supported by bearings parallel to secondary transfer opposing roller 79*b* and pushes against intermediate image transfer body 70 from below in a separable condition.

In order to carry out successive overlapping transfer of the toner images of the first to fourth colors from photoreceptor 1*a* to intermediate image transfer body 70, the primary transfer bias voltage applied has a polarity opposite to that of the toner and is applied from the bias power supply. This applied voltage is, for example, in the range of +100β to +2 kV.

During the primary transfer process of transferring the first to the third color toner image from photoreceptor 1*a* to intermediate image transfer body 70, secondary transfer roller 5*b* and intermediate image transfer body cleaning means 6*b* can be separated from intermediate image transfer body 70.

The transfer of the superimposed color toner image transferred on to belt shaped intermediate image transfer body 70 on to transfer material P which is the second image supporting body is done when secondary transfer roller 5*b* is in contact with the belt of intermediate image transfer body 70, and transfer material P is fed from corresponding sheet feeding resist roller 23*a* via the transfer sheet guide to the contacting nip between secondary transfer roller 5*b* and intermediate image transfer body 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate image transfer body 70 to transfer material P which is the second image supporting body. Transfer material P which has received the transfer of the toner image is guided to fixing device 24*a* and is heated and fixed there.

The photoreceptor of the present invention can be applied in general to all electrophotographic apparatuses such as electrophotographic copiers, laser printers, LED printers, and liquid crystal shutter type printers, and in addition, it is also possible to apply the present invention to a wide range of apparatuses applying electro-photographic technology, such as displays, recorders, light printing equipment, printing plate-making production, and facsimile equipment.

EXAMPLE

Next, the present invention will now be described in detail referring to inventive and comparative examples, but the present invention is not limited thereto. Incidentally, "part" in the description represents "part by weight".

(Surface Treatment of n-Type Semiconducting Particles: Preparation of Titania 1)

Into 10 parts of ethanol/n-propyl alcohol/THF (content ratio of 45:20:35), dissolved and dispersed were 0.2 parts of a copolymer of 1:1 of methylhydrogen polysiloxane and dimethyl siloxane, and after adding 3.5 parts of rutile type titanium oxide (a number average primary particle diameter of 35 nm: 5% primary surface treatment conducted with alumina) into the resulting mixture solvent, the system was stirred for one hour, and separated from the solvent via the surface treatment (secondary treatment) to obtain titania 1 of desired n-type particles which have been subjected to a surface treatment.

{Preparation of Fluorine Resin 1 Represented by Foregoing Formula (1)}

Into a reaction vessel, charged was 200 g of PTFE pellets as raw material, and the system was heated to 450° C. Subsequently, a generated reaction gas was extracted from a reaction vessel outlet while supplying fluorine gas (5% by volume) diluted with nitrogen gas directly into the sample to conduct reaction for one hour, mixed internally in a collection vessel with a fluorine gas diluted to 5% by volume with nitrogen gas at room temperature, and then cooled to produce desired particles. The resulting particles had an average particle diameter of 0.6 μm.

{Preparation of Electrophotographic Photoreceptor 1}

(Intermediate Layer)

After 1 part of binder resin (N-1) was added into 20 parts of ethanol/n-propyl alcohol/THF (content ratio of 45:20:35), and dissolved while stirring, the system was mixed with 4.2 parts of titania 1 to disperse the mixture employing a bead mill. In this case, employed were spherical beads (YTZ ball, produced by Nikkato Corporation) formed from yttria-containing zirconium oxide as a main component having an average particle diameter of 0.1-0.5 mm, and a mill retention time of 3 hours at a filling ratio of 80% and a peripheral speed of 4 m/sec was used to prepare an intermediate layer coating solution. After filtrating the intermediate layer coating solution with a 5 μm filter, the solution was coated onto a washed cylindrical aluminum support (Ten points surface roughness Rz specified by JISB-0601 was roughened to be 0.81 μm via cutting) by an immersion coating method to form an intermediate layer having a dry thickness of 2 μm.

N-1

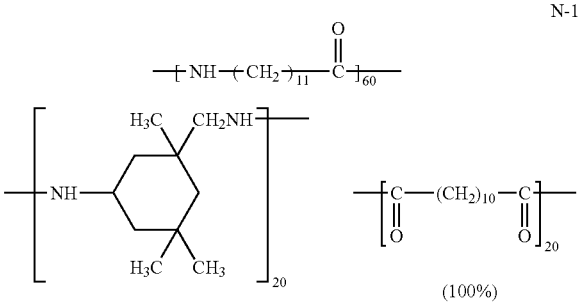

(Charge Generating Layer)

The following components were mixed, and dispersed employing a sand mill to prepare a charge generating layer coating solution. This coating solution was coated onto the above-described intermediate layer by the immersion coating method to form a charge generating layer having a dry thickness of 0.3 μm.

| | |
|---|---|
| Y-titanyl phthalocyanine (Tinanyl phthalocyanine pigment having the maximum diffraction peak at a Bragg angle (2θ ± 0.2°) of 27.3° in an X-ray diffraction spectrum employing Cu—Kα characteristic X-ray) | 20 parts |
| Polyvinyl butyral (BX-1, produced by Sekisui Chemical Co., Ltd.) | 10 parts |
| Methylethyl ketone | 700 parts |
| Cyclohexane | 300 parts |

(Charge transporting layer)

The following components were mixed, and dissolved to prepare a charge transporting layer coating solution. This coating solution was coated onto the above-described charge generating layer by the immersion coating method to form a charge transporting layer having a dry thickness of 20 μm. Polycarbonate resin "Iupilon-Z300" produced by

| | |
|---|---|
| Mitsubishi Gas Chemical Company, Inc. | 100 parts |
| Antioxidant (Compound A) | 8 parts |
| Charge transporting material (Compound B) | 50 parts |
| Tetrahydrofran/Toluene (A volume ratio of 8/2) | 750 parts |

Compound A

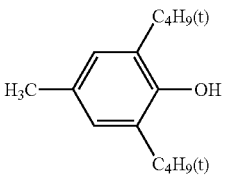

-continued

Compound B

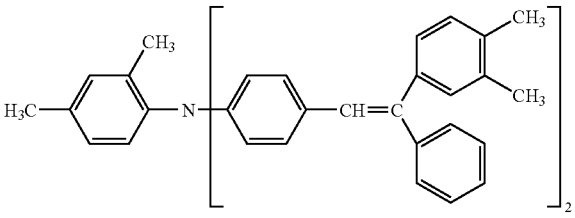

(Protective Layer)

The following components (a)-(e) were mixed, and dispersed for 10 hours employing a sand grinder which filled glass beads having a diameter of 1.5 mm in an amount of 360 g on a bottom area of 90 $cm^2$ (a bead filling amount of 4 $g/cm^2$), and subsequently component (f) was mixed to prepare a protective layer coating liquid. This coating liquid was coated onto the foregoing charge transporting layer by a circular slide hopper coating method, and after irradiating an integral amount of light of 25 $J/cm^2$ employing a mercury lamp exposure apparatus (produced by Eyegraphics Co., Ltd.) and a UV integral illuminance meter UVPF-A1 (produced by Eyegraphics Co., Ltd.), drying was conducted at 120° C. for 60 minutes to form a protective layer having a dry thickness of 2.0 μm.

| | |
|---|---|
| (a) Compound having a cationic polymerization functional group (compound described in Table 1) | 10 parts |
| (b) Titanium oxide (Titania 1 used for an intermediate layer) | 6 parts |
| (c) Fluorine resin 1 | 4 parts |
| (d) 1-Propanol | 50 parts |
| (e) methylisobutyl ketone | 25 parts |
| (f) Compound to start cationic polymerization (compound described in Table 1) | 0.5 parts |

[Preparation of Electrophotographic Photoreceptor 2]

Electrophotographic photoreceptor 2 was prepared similarly to preparation of electrophotographic photoreceptor 1, except that a compound having a cationic polymerization functional group and a compound to start cationic polymerization contained in a protective layer were replaced by those shown in Table 1.

[Preparation of Electrophotographic Photoreceptor 3]

(Preparation of Titania 2)

In 15 parts ethanol/n-propyl alcohol/THF (a volume ratio of 45:20:35), charged were 1.2 parts of methylhydrogen polysiloxane, and the system was dissolved and dispersed. After adding 6.0 parts of anatase-type titanium oxide (a number average primary particle diameter of 6 nm) into the mixed solvent, a surface treatment was conducted for separation from the solvent to obtain desired titania 2 of N type particle which was subjected to the surface treatment.

Electrophotographic photoreceptor 3 was prepared similarly to preparation of electrophotographic photoreceptor 1, except that materials used for a protective layer were replaced by those shown in Table 1.

[Preparation of Electrophotographic Photoreceptor 4]

Electrophotographic photoreceptor 4 was prepared similarly to preparation of electrophotographic photoreceptor 1, except that materials used for a protective layer were replaced by those shown in Table 1.

[Preparation of Electrophotographic Photoreceptor 5]

(Preparation of Zinc Oxide 1)

In 15 parts ethanol/n-propyl alcohol/THF (a volume ratio of 45:20:35), charged were 0.9 parts of methylhydrogen polysiloxane, and the system was dissolved and dispersed. After adding 6.0 parts of zinc oxide (a number average primary particle diameter of 20 nm) into the mixed solvent, a surface treatment was conducted for separation from the solvent to obtain desired zinc oxide 1 of N type particle which was subjected to the surface treatment.

{Preparation of Fluorine Resin 2 Represented by Forgoing Formula (1)}

Into a reaction vessel, charged were 200 g of tetrafluoroethylene-hexafluoropropylene copolymer (FEP), and the system was heated to 400° C. via external heat. Subsequently, the system was reacted for one hour while directly supplying fluorine gas (5% by volume) diluted with nitrogen gas into a sample, and the reactive produced gas was extracted from the reaction vessel outlet, and mixed with fluorine gas diluted with nitrogen gas at room temperature by 1.5% by volume in a collection vessel to prepare desired particles. The resulting particles had an average particle diameter of 1.0 μm.

[Preparation of Electrophotographic Photoreceptor 5]

Electrophotographic photoreceptor 5 was prepared similarly to preparation of electrophotographic photoreceptor 1, except that materials used for a protective layer were replaced by those shown in Table 1.

[Preparation of Electrophotographic Photoreceptor 6]

Electrophotographic photoreceptor 6 was prepared similarly to preparation of electrophotographic photoreceptor 1 up to formation of the charge transporting layer. Fifty % by weight of fluorine resin 2, based on the weight of binder was charged into the charge transporting layer coating liquid and mixed. The resulting was diluted with a mixed solvent of tetrahydrofuran/toluene (a volume ratio of 8/2) until a solid content in the liquid was reduced by half, and dispersed employing a US homogenizer. Subsequently, this charge transporting layer coating liquid was coated onto a charge transporting layer by a circular slide hopper coating method, and drying was carried our at 120° C. for 60 minutes to form the second charge transporting layer having a dry thickness of 7 μm.

[Preparation of Electrophotographic Photoreceptor 7]

(Preparation of Fluorine Resin 3)

Tetrafluoroethylene (TFE) and chloroform were used with a telomerization method to obtain desired particles. The resulting particles had an average particle diameter of 1.2 μm.

Electrophotographic photoreceptor 7 was prepared similarly to preparation of electrophotographic photoreceptor 1, except that materials used for a protective layer were replaced by those shown in Table 1.

[Preparation of Electrophotographic Photoreceptor 8]

Electrophotographic photoreceptor 8 was prepared similarly to preparation of electrophotographic photoreceptor 7, except that fluorine resin 3 used for a protective layer has an average particle diameter of 0.6 μm.

[Preparation of Electrophotographic Photoreceptor 9]

Electrophotographic photoreceptor 9 was prepared similarly to preparation of electrophotographic photoreceptor 1 up to formation of the charge transporting layer, and the charge transporting layer was dried at 120° C. for 60 minutes to form a charge transporting layer so as to give a dry thickness of 26 μm.

TABLE 1

| Electro-photographic photo-receptor | Compound having cationic polymerization functional group: Compound A | Compound B | Compound C | Content ratio of compounds A/B/C (by weight) | Inorganic particle | Organic particle | Compound to start cationic poly-merization | Re-marks |
|---|---|---|---|---|---|---|---|---|
| 1 | ** 9 | ** 5 | — | 60/40/0 | Titania 1 | Fluorine resin 1 | NAI-105 | Inv. |
| 2 | ** 8 | ** 3 | ** 16 | 50/40/10 | Titania 1 | Fluorine resin 1 | PI-105 | Inv. |
| 3 | ** 9 | ** 4 | ** 13 | 60/35/5 | Titania 2 | Fluorine resin 1 | NDI-105 | Inv. |
| 4 | ** 9 | ** 5 | ** 11 | 50/45/5 | Titania 2 | Fluorine resin 1 | Initiator 1 | Inv. |
| 5 | ** 8 | ** 5 | ** 16 | 50/45/5 | Zinc oxide 1 | Fluorine resin 2 | Initiator 2 | Inv. |
| 6 | — | — | — | — | — | Fluorine resin 2 | — | Inv. |
| 7 | ** 9 | ** 6 | — | 60/40/0 | Titania 1 | Fluorine resin 3 | DAM-103 | Comp. |
| 8 | ** 9 | ** 6 | — | 60/40/0 | Titania 1 | Fluorine resin 3 | DAM-103 | Comp. |
| 9 | — | — | — | — | — | — | — | Comp. |

NAI-105

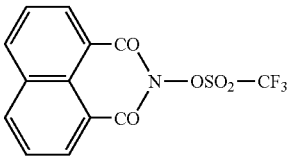

TABLE 1-continued

| Electro-photographic photo-receptor | Compound having cationic polymerization functional group: Compound A | Compound B | Compound C | Content ratio of compounds A/B/C (by weight) | Inorganic particle | Organic particle | Compound to start cationic poly-merization | Re-marks |
|---|---|---|---|---|---|---|---|---|

PI-105

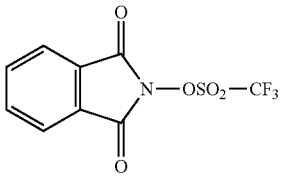

NDI-105

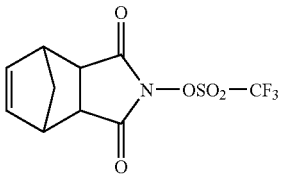

Initiator 1

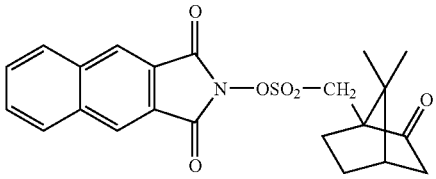

Initiator 2

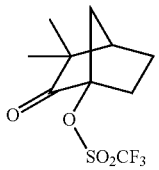

DAM-103

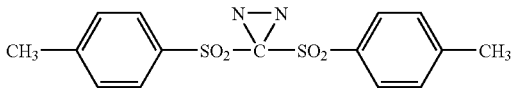

Evaluation

Each of the above-described electrophotographic photoreceptors was installed in a Minolta QMS printer (Magi-Color2300: a rate of 16 A4 size sheets/min., produced by Konica Minolta Business Technologies, Inc.) to evaluate the following evaluation items. In addition, evaluation criteria are shown below. Results are shown in Table 2.

(Evaluation of Film Wastage Amount)

A drum wastage amount after taking practical photographed images corresponding to 100,000 drum rotations was measured at 23° C. and 50% RH.

A deteriorated blade having a worn edge of 10 μm was equipped with a drum after taking practical photographed images corresponding to the 100,000 revolutions at 10° C. and 15% RH, and a spring load was changed to evaluate a cleaning critical load as described below.

| Rank | Cleaning critical load (N/m) |
|---|---|
| 5: | Less than 9 |
| 4: | At least 9 and less than 13 |

-continued

| Rank | Cleaning critical load (N/m) |
|---|---|
| 3: | At least 13 and less than 17 |
| 2: | At least 17 and less than 21 |
| 1: | At least 21 |

At least rank 3 indicates to be practically usable.

(Evaluation of Image Smear)

Practical photographed images corresponding to 20,000 drum revolutions were taken at 30° C. and 85% RH, and images at a point of 12 hours after completion of taking the practical photographed images were visually evaluated.

A: No image smear is observed.

B: Image smear is hardly observed.

C: Image smear is partly generated, resulting in being not durable in practical use.

D: Image smear is generated entirely, resulting in being totally undurable in practical use.

TABLE 2

| Sample No. | Wastage amount [μm] | Cleaning property at low temperature and low humidity | Image smear at high temperature and high humidity | Remarks |
|---|---|---|---|---|
| 1 | 0.3 | Rank 5 | A | Inv. |
| 2 | 0.9 | Rank 4 | A | Inv. |
| 3 | 0.4 | Rank 5 | A | Inv. |
| 4 | 0.4 | Rank 5 | A | Inv. |
| 5 | 0.7 | Rank 4 | B | Inv. |
| 6 | 3.0 | Rank 3 | A | Inv. |
| 7 | 0.8 | Rank 2 | C | Comp. |
| 8 | 0.7 | Rank 2 | D | Comp. |
| 9 | 4.3 | Rank 1 | A | Comp. |

Inv.: Present invention, Comp.: Comparative example

As is clear from Table 2, it is to be understood that the electrophotographic photoreceptor of the present invention strikes a balance between improved mechanical strength and an easy cleaning property, and exhibits an excellent property against image smear.

EFFECT OF THE INVENTION

The present invention is possible to provide a high releasing electrophotographic photoreceptor maintaining lubricity for a long duration and exhibiting high mechanical strength, and also to provide a process cartridge and an image forming apparatus employing the same.

What is claimed is:

1. An electrophotographic photoreceptor comprising a conductive support and provided thereon, a photosensitive layer, wherein an outermost layer of the electrophotographic photoreceptor comprises a fluorine resin represented by Formula (1):

Formula (1)

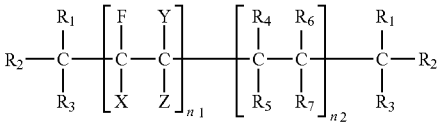

wherein each of X, Y and Z independently represents a hydrogen atom, a halogen atom, a halogen-substituted alkyl group or a halogen-substituted alkoxy group; at least one of X, Y and Z represents a fluorine atom; each of $R_4$, $R_5$, $R_6$ and $R_7$ independently represents a hydrogen atom, a halogen atom or a halogen-substituted alkyl group, provided that the halogen atom is not a fluorine atom, and repeating units represented by "—CF(X)—CY(Z)-" or "—$CR_4(R_5)$—$CR_6(R_7)$" may be identical or different; each of $R_1$, $R_2$, and $R_3$ independently represents a hydrogen atom, a halogen atom or a halogen-substituted alkyl group; at least one of $R_1$, $R_2$, and $R_3$ represents a fluorine atom; n1 represents an integer of 1-8000; and n2 represents an integer of 0-4000; and wherein the outermost layer is an activation energy radiation cationic reaction curing film acquired by exposing to activation energy radiation a composition comprising a compound having a cationic polymerization functional group and a compound to start cationic polymerization via exposure to activation energy radiation, and the compound to start cationic polymerization is a nonionic compound.

2. The electrophotographic photoreceptor of claim 1, wherein the fluorine resin is polytetrafluoroethylene represented by Formula (2):

Formula (2) $CF_3$—$(CF_2$—$CF_2)_m$—$CF_3$, provided that m represents an integer of 1-8000.

3. The electrophotographic photoreceptor of claim 1, wherein the photosensitive layer comprises a charge generating layer, a first charge transporting layer containing a charge transporting material and a second charge transporting layer containing a charge transporting material that are laminated in this order, and the second charge transporting layer is the outermost layer.

4. The electrophotographic photoreceptor of claim 1, wherein the compound having a cationic polymerization functional group comprises an oxetane compound or an epoxy compound, provided that the oxetane compound and the epoxy compound each comprise 2-15 functional groups.

5. The electrophotographic photoreceptor of claim 1, wherein the outermost layer comprises inorganic particles.

6. The electrophotographic photoreceptor of claim 5, wherein the inorganic particles comprise titanium oxide or zinc oxide.

7. A process cartridge used in an image forming apparatus comprising:

(a) an electrophotographic photoreceptor;

(b) a device of charging the electrophotographic photoreceptor;

(c) a device of forming an electrostatic latent image;

(d) a developing device to visualize the electrostatic latent image on the electrophotographic photoreceptor;

(e) a device of transferring a toner image visualized on the electrophotographic photoreceptor onto a transfer material; and (f) a cleaning device to remove toner remaining on the electrophotographic photoreceptor after the transferring, wherein the electrophotographic photoreceptor of claim 1 equipped with at least one of the charging device, the electrostatic latent image forming device, the developing device, the transferring device and the cleaning device is supported as an integrated unit, and the unit is capable of mounting on the image forming apparatus or removing from the image forming apparatus freely.

8. An image forming apparatus comprising:

(a) an electrophotographic photoreceptor;

(b) a device of charging the electrophotographic photoreceptor;

(c) a device of forming an electrostatic latent image;

(d) a developing device to visualize the electrostatic latent image on the electrographic photoreceptor;

(e) a device of transferring a toner image visualized on the electrophotographic photoreceptor onto a transfer material; and (f) a cleaning device to remove toner remaining on the electrophotographic photoreceptor after the transferring, wherein the image forming apparatus comprises the electrophotographic photoreceptor of claim 1.

* * * * *